US005730449A

United States Patent [19]

Miles

[11] Patent Number: 5,730,449

[45] **Date of Patent: *Mar. 24, 1998**

[54] FOLDABLE CREEPER WITH RECESSED WHEELS

[75] Inventor: Joseph J. Miles, Okeechobee, Fla.

[73] Assignee: Mechanic Accessory, Inc., Okeechobee, Fla.

[ * ] Notice: The term of this patent shall not extend beyond the expiration date of Pat. No. 5,611,552.

[21] Appl. No.: 550,829

[22] Filed: Oct. 31, 1995

[51] Int. Cl.[6] ..... B25H 5/00

[52] U.S. Cl. ..... 280/32.6; 280/32.5; 280/639

[58] Field of Search ..... 280/32.5, 32.6, 280/639, 640, 651, 79.11

[56] References Cited

U.S. PATENT DOCUMENTS

| | | | |
|---|---|---|---|
| D. 270,962 | 10/1983 | Martell | 280/32.6 |
| 781,243 | 1/1905 | Thompson | 280/32.6 |
| 1,226,585 | 5/1917 | Parker et al. | 280/32.6 |
| 1,302,301 | 4/1919 | Broome | 280/32.6 |
| 1,643,268 | 9/1927 | Burnwatt | 280/32.6 |
| 4,570,957 | 2/1986 | Rose | 280/32.6 |
| 4,580,799 | 4/1986 | Quinonez | 280/639 |
| 5,174,592 | 12/1992 | Pool | 280/32.6 |
| 5,195,763 | 3/1993 | Scott et al. | 280/32.6 |
| 5,251,359 | 10/1993 | Finkl | 403/102 |
| 5,451,068 | 9/1995 | Shockley | 280/32.6 |
| 5,494,305 | 2/1996 | Chen | 280/32.6 |
| 5,611,552 | 3/1997 | Miles et al. | 280/32.6 |

FOREIGN PATENT DOCUMENTS

| | | | |
|---|---|---|---|
| 810882 | 3/1959 | United Kingdom | 280/651 |

OTHER PUBLICATIONS

Damark International, Inc. Catalog, p. 21, Sep. 1995.

*Primary Examiner*—Brian L. Johnson
*Assistant Examiner*—Min Yu
*Attorney, Agent, or Firm*—Stein, Pendorf & Van Der Wall

[57] ABSTRACT

A foldable creeper for supporting a person, the creeper articulated along a line which extends transversely along the approximate longitudinal centerline for movement between an open position and a folded storage position, and comprising articulating joints, a framework comprising longitudinal and transverse frame members, the longitudinal frame members constructed with a plurality of arches sized to accommodate the attachment of casters, the transverse frame members rigidly connecting left and right longitudinal frame members, the lower surface, and preferably the upper surface, of said transverse frame members positioned below the apex of the concave portion of the arched caster attachment points when said creeper is in the open position, support panels having top sides and bottom sides and connected to said transverse frame members, and casters connected to the frame members for supporting said frame members above the ground when said creeper is in the open position. The creeper is light weight, reduced in thickness, easy to manipulate, and in a preferred embodiment can be folded so that the wheels can be positioned inwards when the creeper is folded.

21 Claims, 2 Drawing Sheets

FOLDABLE CREEPER WITH RECESSED WHEELS

BACKGROUND OF THE INVENTION

1. Field of the Invention

The present invention is directed to a mechanic's creeper as conventionally used in maintenance of vehicles, and more particularly, to a creeper which can be folded for storage in small storage areas such as a mechanic's tool chest or a vehicle storage area.

2. Description of the Related Art

Creeper devices basically consist of a low-slung rectangular body-supporting platform with casters. Such devices have long been popular among automobile mechanics to allow them easy access to the underside of an automobile. Since creepers are conventionally used in commercial automotive repair facilities where strength and wear resistance are required, creepers have conventionally been sturdy, heavy, and expensive devices. A major draw-back to such creepers is that they can not be secured, for example, inside a conventional mechanic's tool chest. A creeper which is left unattended for days or weeks may disappear. Mechanics tool chests are conventionally provided with drawers of 5 inches in depth and 8 inches in depth. There is thus a need for a sturdy mechanic's creeper which can be made to fit inside a conventional mechanic's tool chest.

Due to their large size and expense, creepers have not been widely used outside of commercial automotive repair facilities. There are, however, a number of uses to which creepers could be put if the creepers were not so expensive and did not require so much space.

For example, long-distance truckers are required to make pre-trip and daily visual undercarriage inspections of the brakes and electrical systems of their vehicles. However, it is difficult to slide underneath a truck, particularly a truck which is provided with an aerodynamic skirt. Further, the tarmac of truck parking areas is frequently oily and dirty. A creeper would be a great asset to a trucker, but creepers are difficult to carry along in a truck.

There are other potential uses for creepers by non-commercial persons such as homeowners. For example, it would be desirable to provide more comfortable access to confined low spaces when doing plumbing, home repair, and a multitude of other homeowner tasks which require awkward positioning of the body. Further, backyard mechanics and owners of recreational vehicles require access to the undercarriage of automobiles or recreational vehicles when changing oil or transmission fluid, or inspecting brakes or mechanical components. However, homeowners and recreational vehicle operators have limited space to store tools. Thus, homeowners rarely have mechanic's creepers, and such operations are conventionally carried out by the home mechanic simply crawling under a vehicle while lying on his back. This can lead to oil, grease and dirt on the clothes, which dirt and grease can be transmitted to the home or recreational vehicle if the operator does not have time to change clothes.

Another concern of the homeowner is the ease with which the tool can be used. Tools which are not intuitively easy to use are frequently not purchased or, if purchased, are not used. Other concerns include the cost and aesthetic appearance of the tool.

With the above in mind, various attempts have been made over time to provide a foldable creeper which meets the need of the homeowner, the backyard mechanic, and the recreational vehicle operator.

One approach to addressing the problem of limited space which homeowners and recreational vehicle owners have to store tools is taught in U.S. Pat. No. 4,889,352 (Chamberlain). Chamberlain teaches a hard foldable creeper comprising two plastic panels hinged to each other. Although the Chamberlain creeper is foldable, the plastic panels are not sufficiently sturdy to bear up to continuous daily use such as by commercial mechanics. Further, the plastic panels are basically hollow, and will not provide sufficient strength for anchoring castors or wheels. Furthermore, due to the design of the hinging mechanism, the creeper can not be folded with the casters left in their bosses. For folding, it is necessary to remove the casters from their respective bosses, and these casters must be stored. This is an inconvenience to the user, increases the wear of the caster sockets, and furthermore allows for the possibility that the casters can become misplaced. One lost caster renders the creeper useless. Finally, as the creeper is not padded, it can not be comfortably used for long periods of time.

Another foldable creeper is taught in U.S. Pat. No. 4,580,799 (Quinonez). Quinonez teaches a foldable creeper with a collapsible seat. However, although the length of the creeper is reduced, the creeper is very thick and bulky when folded and, therefore, is difficult to store within the limited storage space available to a homeowner either in the home or in a vehicle. Furthermore, the casters always face outwards when the creeper is folded. Therefore, if the creeper casters come into contact with grease or dirt, which is likely due to the environment of use, there exists the potential of transmitting dirt and/or grease from the ground to the casters and from the casters to the area in which the creeper will be stored. This is severely limiting to a homeowner who often stores items of this sort in their clean home or vehicle. This creeper is also not padded.

Yet another foldable creeper is taught in U.S. Pat. No. 3,984,116 (Bowers). The creeper comprises a tri-sectional panel and a telescopic supporting rail section attached to one of the three panels, such that when the panels are unfolded the rail can be extended to provide a backbone for supporting the panels. This creeper is bulky in its folded state which makes it difficult to store in small spaces. The tri-section construction also raises the manufacturing costs of the creeper which will, in turn, raise the price with which the creeper is sold. Furthermore, the casters are constrained to facing outwards in the creeper's folded state and this raises the possibility of transmitting dirt or grease. Finally, the creeper is flat and hard and not comfortable.

Given the public's need to utilize creepers for a variety of tasks requiring awkward positioning of the body, it is an object of the present invention to provide a creeper that is compact, affordable, easy to use, and attenuates the amount of dirt that is transferred from the used creeper to a storage area.

SUMMARY OF THE INVENTION

In view of the foregoing disadvantages inherent in known types of foldable creepers, it is an object of the present invention to provide a creeper which can be compactly folded so that it can be placed in the limited storage area available to homeowners.

It is a further object of the present invention to provide a creeper which can be inexpensively manufactured yet be comfortable, durable, and attractive.

Yet a further object of the present invention is to provide a creeper which can be folded so as to hide the wheels, without requiring removal of the wheels, thus minimizing the amount of dirt and/or grease that can be transferred from the creeper to its storage area or to the user's body.

It is yet a further object of the invention to provide a of foldable creeper which provides the user a wide range of motion, especially when the user is in a prone position.

It is yet another object of the invention to provide a creeper which provides padded support and thus can be used for extended periods of time.

Finally, it is an object of the invention to provide a creeper which provides superior comfort, ease of folding, and yet can be folded to a thickness of 10 inches or less, preferably 6.5 inches or less, most preferably 4.5 inches or less.

These and other objects are accomplished by providing a foldable creeper with a unique framework, hinging means, and caster arrangement such that casters of the creeper can be directed inwards when the creeper is in its folded state. A compact arrangement is made when the creeper is folded with wheels facing inward. In this manner of folding, the total creeper thickness will be slightly more than twice the frame thickness plus approximately one times the projection length of the casters from the frame members. That is, since the wheels face inwards all wheels will be roughly side-by-side when the creeper is folded.

The structure of the hinging means, however, also allows placement of casters proximal to the hinging mechanism, i.e., on the frame near the center of the creeper, while still allowing the creeper to be properly folded. Therefore, the creeper can withstand large forces exerted against it's center without collapsing. In addition, not only does the inward positioning of the casters while the creeper is in its folded state attenuate transmission of dirt and/or grease but it allows the present creeper to be more compact than other foldable creepers.

In accordance with the invention, the hinging mechanism, frame design, and caster placement permits the creeper to be folded in a wheels-in orientation.

Further, the creeper should, in addition to all the above, be provided with a headrest for increasing the comfort of the mechanic.

Furthermore, the frame is assembled from high-strength frame members, preferably steel beams or tubes, and thus the load bearing members are strong and long-lasting. The frame members may also be constructed of a lightweight material such as aluminum, titanium, magnesium, KEVLAR, carbon-fiber, or high strength plastic. The longitudinal frame members and transverse frame members could be produced as separate pieces which could be welded or screwed together, or alternatively constructed from one piece to form either right angles, a "U" shaped segment or a closed roughly rectangular shape. When constructed, the creeper should be smooth with no rough or sharp projections.

The foregoing has outlined rather broadly the more pertinent and important features of the present invention in order that the detailed description of the invention that follows may be better understood and so that the present contribution to the art can be more fully appreciated. Additional features of the invention will be described hereinafter which form the subject of the claims of the invention. It should be appreciated by those skilled in the art that the conception and the specific embodiments disclosed may be readily utilized as a basis for modifying or designing other foldable creepers for carrying out the same purposes of the present invention. It should also be realized by those skilled in the art that such equivalent structures do not depart from the spirit and scope of the invention as set forth in the appended claims.

BRIEF DESCRIPTION OF THE DRAWINGS

For a fuller understanding of the nature and objects of the present invention reference should be made by the following detailed description taken in with the accompanying drawings in which.

DETAILED DESCRIPTION OF THE INVENTION

After extensive investigation, the inventor has discovered that a creeper can be designed and constructed so as to be attractive and comfortable, durable, inexpensive, foldable to a compact state, and which is less likely to transmit dirt to the user or storage area. In a preferred embodiment of the present invention, the two frame portions are connected via a hinging means such that the creeper can be folded into a wheels-in arrangement. Such arrangement is a compact enough structure such that the creeper can be easily stored in the home or a vehicle.

Figure 1:
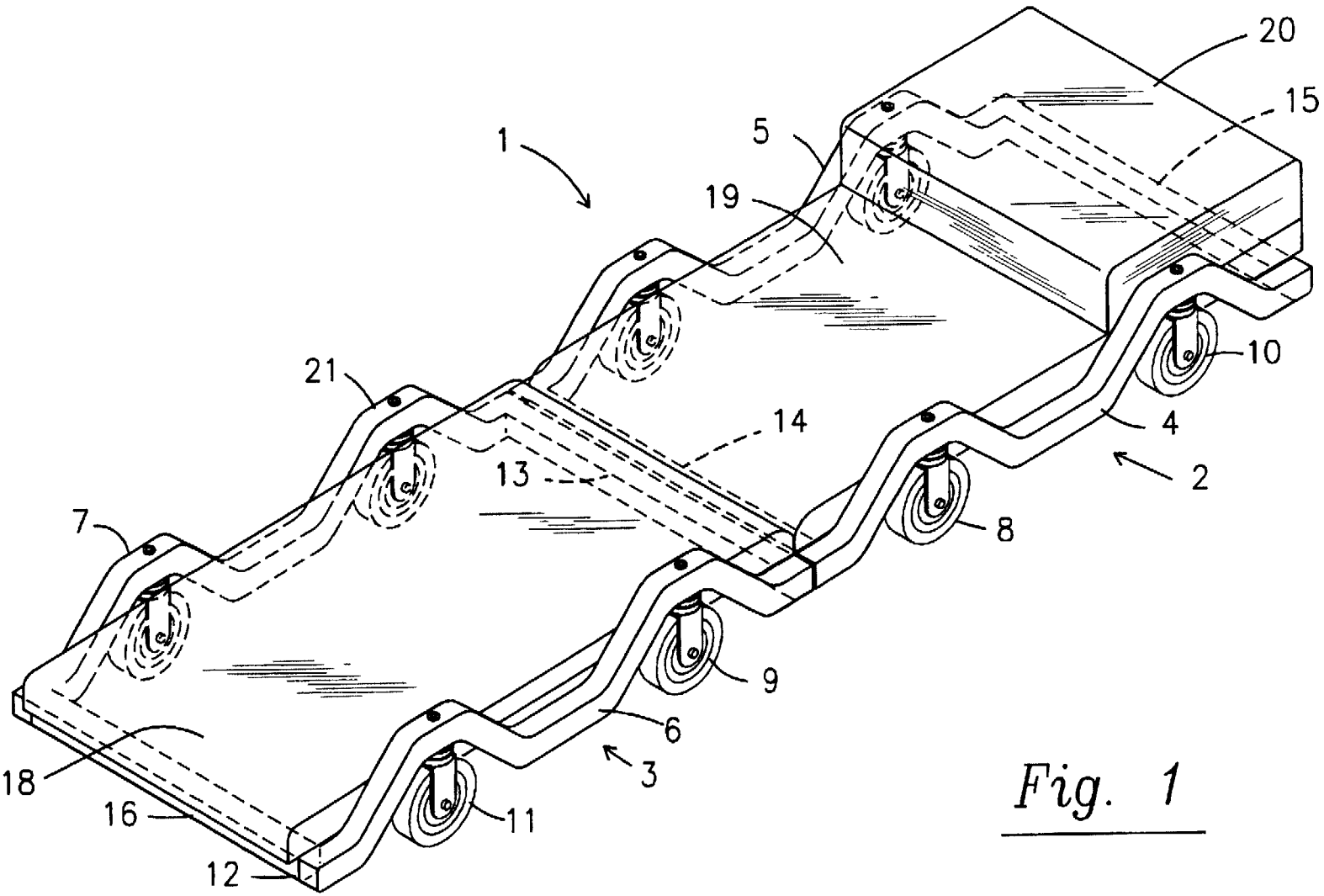
FIG. 1 is an elevated oblique view of a first embodiment of the foldable creeper in its unfolded state.
Figure 2:
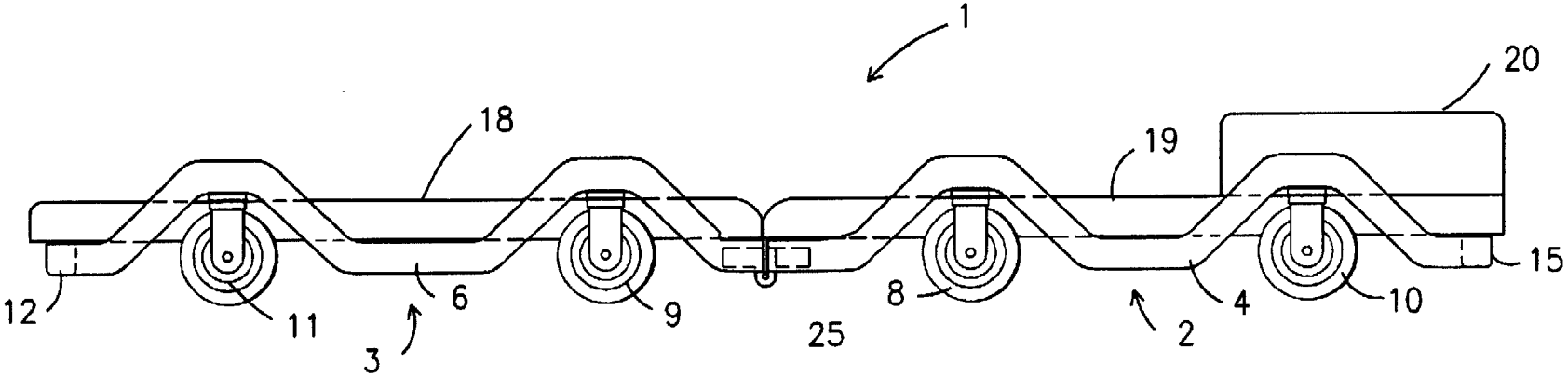
FIG. 2 is a side view of the foldable creeper of FIG. 1 in its unfolded state.
Figure 3:
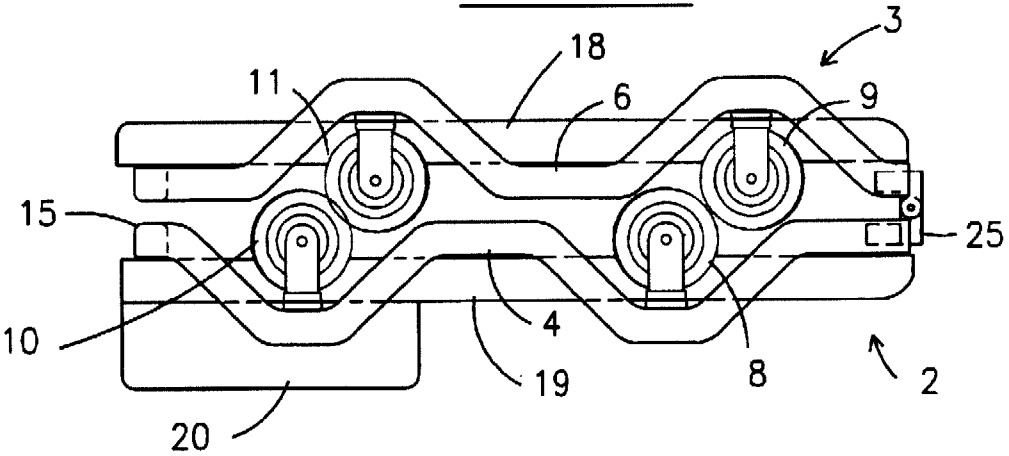
FIG. 3 is a side view of the foldable creeper of FIG. 1 in its folded state.

The creeper is constructed around a framework comprised of longitudinal and transverse frame members. The term "transverse" is intended to refer to frame members which connect left and right longitudinal sides of the frame. There is no requirement that the transverse members be perpendicular to the longitudinal frame members - the transverse members may be perpendicular or may diagonal so as to form a cross. Perpendicular transverse members are preferred. The longitudinal members extend lengthwise along the sides of the creeper. In the preferred embodiment of the invention as shown in FIGS. 1–3 the longitudinal members are separated into two segments at approximately the center of the total creeper length, and connected to each other with a conventional hinge such as a flat tear-drop hinge. Each of the transverse frame members extends from one longitudinal member to the other longitudinal member, forming a rigid framework. The longitudinal frame members are constructed with a plurality of arches sized to accommodate the attachment of casters. The transverse frame members are positioned one or more inches, preferably about two to three inches, below the attachment point(s) of the casters along the longitudinal frame members when the creeper is in the unfolded state. Thus, when viewed from either end of the creeper, the transverse frame members appear to form a platform with a straight transverse or cradle portion. Support panels are connected to the strait transverse part of the transverse frame members, and padding is provided on the support panels. When the creeper with the conventional hinge is folded, the positioning of the transverse members several inches below the caster attachment point on the longitudinal members permits the creeper to be folded compactly with the casters facing in-ward.

The cushion attached to the support panel attached to the transverse members is constructed so as to give a comfortable surface on which the user of the creeper may lie. A headrest is attached to the cushion to further increase the comfort with which the creeper can be used.

The longitudinal frame members are provided with downward-facing casters such that the casters contact the ground and support the creeper above the ground when in use. The casters are attached to the longitudinal frame members in conventional manner so as to both rotate and swivel. Preferably each of the four longitudinal frame member segments is provided with at least two casters, one near the hinge and one away from the hinge, such that the creeper is provided with a total of at least eight casters. This is the minimum number of casters for providing the strongest support for the creeper, such that the creeper can withstand large forces placed on it, for example, forces generated by the weight of a body plus the force of the mechanic working on a vehicle, without collapse. A total of at least four casters per folding segment (half) of the creeper will ensure optimal stability.

Each longitudinal frame member defines a plurality of spaced arches sized to accommodate the positioning of casters therein. The plurality of spaced arches are aligned asymmetrically relative to the hinged articulating joint so that when the creeper is in the folded position, the casters are oriented so that they do not contact one another. Additionally, the inside concave portion of the arch must be a sufficient height above the transverse member so that the casters keep the creeper sufficiently off the ground.

The frame design allows the creeper to be easily manipulated, compactly folded, conveniently stored, and inexpensively manufactured.

Figure 4:
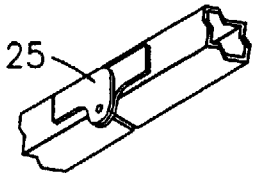
FIG. 4 is an elevated oblique view of a preferred hinging mechanism.

A means for connecting the longitudinal frame members to permit pivoting is shown in FIG. 4. The longitudinal frame members are connected to each other by means of a hinge formed of a flat bar segments which are attached to the longitudinal frame members by means of hinge pins. Optionally, to make the creeper rigid and incapable of collapse, the hinge means is provided with a locking means such as locking pin.

An important consideration in the embodiment of the invention is to provide the casters on each longitudinal frame member offset relative to the corresponding casters on the opposing frame member so that the creeper can be properly folded without the casters coming into contact with each other and without coming into contact with the transverse frame members, as clearly shown in FIG. 3.

The operation of the foldable creeper will now be explained in greater detail. After removing the creeper from its storage area, the creeper is transformed from its folded state into its unfolded state. The unhinged head and foot ends of the frame are pulled apart until the frame portions are coplanar and form a conventionally shaped creeper, and the creeper is placed on the ground in the unfolded state, with only the casters touching the ground. The user of the creeper will then lie on the cushions which rest on the transverse members of the frame piece, usually with his/her head facing upwards but not necessarily so. The creeper can then be rolled within close proximity of the area to be worked on by the user while the user is lying on the cushions. Sliding of the creeper can be accomplished by pushing or pulling the creeper with one's hands or legs while lying on its cushions. The area to be worked on will usually be just above the creeper and fairly low to the ground. However, it is to be emphasized that the creeper can be utilized for any task for which the user wishes. Once the task is complete and the user wishes to store the creeper for future use, the user grasps the frame portions at their unhinged ends and brings the two ends within close proximity of each other, whereby one frame portion describes an arc of about 180 degrees. The creeper, in its folded state, is then stored in a closet, tool box, recreational vehicle, trunk of a car, etc.

A preferred embodiment of the foldable creeper according to the invention will now be discussed in greater detail by reference to FIGS. 1–3. There is shown in FIG. 1, a creeper 1 comprising two hinged frame portions 2, 3. The first frame portion 2 comprises two longitudinal frame members 4, 5. The second frame portion 3 comprises two longitudinal frame members 6, 7. Each longitudinal frame portion is preferably from 18 to 28 inches, most preferably about 20 inches, in length. Each longitudinal frame member 4, 5, 6, 7 is provided with one inner caster 8, 9 and one outer caster 11, i.e., one caster nearer the hinge and one caster further from the hinge. Each longitudinal frame member 4, 5, 6, 7 define a plurality of spaced arches 21 which are sized to accommodate the positioning of casters therein.

Connecting the longitudinal frame members 4, 5, 6, 7 to each other are transverse frame members 12, 13, 14, 15. The lower surface, and preferably the upper surface of the transverse frame members are generally positioned below the apex of the concave portion of the arched caster attachment points when viewed from the ends of the creeper. Each transverse frame member is preferably from 15 to 25 inches, most preferably about 17 inches in width. More specifically, the transverse frame members preferably comprise a main horizontal segment 16 connected to longitudinal segments 6, 7.

For the comfort of the mechanic, cushions 18, 19 are provided on each of the frame portions 2, 3. The cushions are generally provided on a rigid support (not shown) such as a section of plywood, plastic, or metal, in order to provide planar support for the mechanic. The cushion may be made of any material generally employed in the art for providing comfort for the mechanic. For example, the cushion may be a foamed rubber (e.g., foamed neoprene, polyurethane, or polyethylene, preferably cross-linked polyethylene), or foamed plastic (e.g., foamed urea-formaldehyde, foamed polyvinyl-formaldehyde plastic, polyester resin reacted with aromatic diisocyanates to form a prepolymer which is then reacted with water to form a plastic urethane polymer which is foamed by coevolved carbon dioxide, phenolformaldehyde resin foams, and polystyrene), natural sponge, or any other such natural or synthetic material known to those in the art to have good stability, biocompatibility, resilience, and impact absorption abilities. The density of the foam layer may vary widely depending upon engineering preferences, but is preferably about 4–6 lbs. per cubic foot, most preferably about 5 lbs. per cubic foot. The layer thickness is not particularly limited, but the cushion has a preferred thickness of about ¼–2 inches. A cushion thicker than 2 inch does not provide significant additional support or comfort, yet increases manufacturing cost and may increase the overall creeper thickness when folded. A cushion less than ½ inch in thickness is reduced in the amount of support and comfort afforded, and less than ¼ will usually not give sufficient support for the desired level of comfort. The foam material is preferably covered by a wear resistant material such as cloth backed polyvinyl chloride.

A headrest 20 may be provided for additional comfort. The headrest is preferably made of the same material as the cushion part 18, 19, but is simply thicker, and is provided at one end of the creeper where the head is expected to rest.

FIG. 2 shows the creeper in the open, unfolded position, with longitudinal frame members 4, 6 aligned. FIG. 3 shows the same creeper as in FIG. 2, but in the closed, folded position, with longitudinal frame members 4, 6 facing each other.

As shown in these figures, the frame members are roughly square in cross-sectional shape, but they may be any desired shape, including circular, oval, or "U" or "L" shaped, and they may be hollow or solid, so long as sufficient strength is imparted.

The lengths and diameters of both the longitudinal and transverse frame members may vary widely depending upon the ultimate design selected by the manufacturer, and may be influenced by consideration such as the size of the person to be accommodated on the creeper, the strength desired for the frame piece, cost, and the ultimate thickness of the creeper in its folded state. The longitudinal and transverse frame members may be welded to each other, bolted to each other, or joined by any conventional means.

It should be apparent from FIGS. 1–3 that the cushion 18, 19 and, optionally, headrest 20 are recessed below the inside apex of the concave portion of the defined arch 21 so that when the creeper is in the open state on the ground cushion 18, 19 is supported by the transverse frame members 12, 13, 14, 15 slightly above the ground, yet so that the top of the cushion 18, 19 is below the inside apex of the concave portion of the defined longitudinal member arch. This has the advantage that the mechanic is supported closer to the ground, such that the clearance between the mechanic and the underside of the vehicle on which he is working is greater.

The creeper as shown in FIGS. 1–4 may be provided with any conventional hinge, such as a "piano" hinge, but it is preferably provided with a hinge which satisfies two conditions: (1) the longitudinal frame members abut when the creeper is in the open position, and (2) the longitudinal frame members are slightly spaced apart at the hinged end when the creeper is in the closed position, so as to provide room for any caster mounting hardware extending above the upper surface of the longitudinal frame members. That is, without the provision of a small space at the hinge, any hardware for mounting the casters is likely to break the hinges when the creeper is closed. The casters and the transverse frame members must also be spaced so as not to interfere with each other in folding.

Securing means such as straps may also be provided to secure the creeper 1 is in its folded state, for example, for storage in a recreational vehicle. The straps can be releasably attached to the sides of the creeper 1 through the use of snaps or some other commonly used means.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

Now that the invention has been described,

What is claimed is:

1. A foldable creeper for supporting a person, said creeper having a top side, a bottom side, left and right sides, and head and foot ends, said creeper articulated along a line which extends transversely along the approximate longitudinal centerline for movement between an open position and a folded storage position, and comprising:

(a) articulating joints;

(b) a framework comprising longitudinal and transverse frame members, said longitudinal frame members extending lengthwise along said left and right sides of the creeper, said longitudinal frame members articulated via said articulating joints at a line which extends transversely along the approximate longitudinal centerline to define head-end longitudinal frame members segments and foot-end longitudinal frame member segments, in each longitudinal frame member, wherein each of said longitudinal frame member segments defines at least one arch, wherein said arches are sized to accommodate the positioning of casters therein, and wherein said arches are spaces asymmetrical relative to said articulating joints said transverse frame members rigidly connecting left and right longitudinal frame members, said transverse frame members defining a lower platform for supporting a support panel;

(c) support panels having top sides and bottom sides and connected to said transverse frame members; and (d) casters coupled at caster attachment points to said longitudinal frame members for supporting said frame members above the ground when said creeper is in the open position, said casters positioned asymmetrically relative to said articulating joint such that casters are side-by-side when said creeper is in the folded storage position;

wherein said lower platform of said transverse member is oriented from one-half to four inches below the caster attachment point of said longitudinal frame members when said creeper is in the open position, wherein said articulating joints permit said creeper to be folded such that said bottom sides of said support panels face each other when said creeper is in the folded position.

2. A foldable creeper as in claim 1, wherein said left and right head-end longitudinal frame member segments are connected to each other via at least two transverse frame member segments, and wherein said left and right foot-end longitudinal frame member segments are connected to each other via at least two transverse frame member segments.

3. A foldable creeper as in claim 1, wherein said longitudinal and transverse frame members are hollow.

4. A foldable creeper as in claim 1, wherein said longitudinal and transverse frame members are metal.

5. A foldable creeper as in claim 1, wherein said head-end longitudinal frame member segment and associated transverse frame members are constructed of one piece to form right angles.

6. A foldable creeper as in claim 1, wherein said foot-end longitudinal frame member segment and associated transverse frame members are constructed of one piece to form right angles.

7. A foldable creeper, as in claim 1, wherein said head-end longitudinal frame member segment and associated transverse frame members are formed from one piece to form a rectangular part.

8. A foldable creeper, as in claim 1, wherein said foot-end longitudinal frame member segment and associated transverse frame members are formed from one piece to form a rectangular part.

9. A foldable creeper as in claim 1, further including padding provided on the top side of said support panels.

10. A foldable creeper as in claim 9 further including a headrest at said head end of said creeper.

11. A foldable creeper as in claim 1, wherein said lower platform of each of said transverse frame members is positioned from one to four inches below the caster attachment point of said longitudinal frame members when said creeper is in the open position.

12. A foldable creeper as in claim 1, wherein said lower platform of each of said transverse frame members is positioned from two to three inches below the caster attachment point of said longitudinal frame members when said creeper is in the open position.

13. A foldable creeper as in claim 1, wherein said left head-end longitudinal frame member segment is in close proximity to said left foot-end longitudinal frame member segment and said right head-end longitudinal frame member segment is in close proximity to said right foot-end longitudinal frame member segment when said creeper is in the folded position.

14. A foldable creeper as in claim 1, wherein each of said head-end longitudinal frame member segments and foot-end longitudinal frame member segments is provided with at least two casters.

15. A foldable creeper as in claim 1, wherein said transverse frame members are spaced from each other when the creeper is in a folded position.

16. A foldable creeper as in claim 1, wherein said head-end longitudinal frame member segment and associated transverse frame members are constructed of one piece to form a U-shaped part.

17. A foldable creeper as in claim 1, wherein said foot-end longitudinal frame member segment and associated transverse frame members are constructed of one piece to form a U-shaped part.

18. A foldable creeper for supporting a person, said creeper having a top side, a bottom side, left and right sides, and head and foot ends, said creeper articulated along a line which extends transversely along the approximate longitudinal centerline for movement between an open position and a folded storage position, and comprising:

(a) articulating joints;

(b) a framework comprising longitudinal and transverse frame members, said longitudinal frame members extending lengthwise along said left and right sides of the creeper, said longitudinal frame members articulated via said articulating joints at a line which extends transversely along the approximate longitudinal centerline to define head-end longitudinal frame members segments and foot-end longitudinal frame member segments, in each longitudinal frame member, wherein said longitudinal frame members define a plurality of arches spaced asymetrically relative to said articulating joints sized to accommodate the positioning of said casters therein, said transverse frame members rigidly connecting left and right longitudinal frame members, said transverse frame members defining a lower platform for supporting a support panel;

(c) support panels having top sides and bottom sides and connected to said transverse frame members; and (d) casters coupled at caster attachment points to said longitudinal frame members for supporting said frame members above the ground when said creeper is in the open position, said casters being positioned asymmetrically relative to said articulating joint such that casters are side-by-side when said creeper is in the folded storage position;

wherein said lower platform of said transverse member is oriented from one-half to four inches below the caster attachment point of said longitudinal frame members when said creeper is in the open position, wherein said articulating joints permit said creeper to be folded such that said bottom sides of said support panels face each other when said creeper is in the folded position.

19. A foldable creeper as in claim 18, wherein said transverse frame members are spaced from each other when the creeper is in a folded position.

20. A foldable creeper for supporting a person, said creeper having a top side, a bottom side, left and right sides, and head and foot ends, said creeper articulated along a line which extends transversely along the approximate longitudinal centerline for movement between an open position and a folded storage position, and comprising:

(a) articulating joints;

(b) a framework comprising longitudinal and transverse frame members, said longitudinal frame members extending lengthwise along said left and right sides of the creeper, said longitudinal frame members articulated via said articulating joints at a line which extends transversely along the approximate longitudinal centerline to define head-end longitudinal frame members segments and foot-end longitudinal frame member segments, in each longitudinal frame member, wherein said longitudinal frame members define a plurality of spaced arches sized to accommodate the positioning of said casters therein, said plurality of arches spaced asymmetrically relative to said articulating joints such that when said foldable creeper is in the folded position said arches are oriented such that the casters are spaced from each other when the creeper is in a folded position, said transverse frame members rigidly connecting left and right longitudinal frame members, said transverse frame members defining a lower platform for supporting a support panel;

(c) support panels having top sides and bottom sides and connected to said transverse frame members; and (d) casters coupled at caster attachment points to said longitudinal frame members for supporting said frame members above the ground when said creeper is in the open position, said casters being positioned asymmetrically relative to said articulating joint such that casters are side-by-side when said creeper is in the folded storage position;

wherein said lower platform of said transverse member is oriented from one-half to four inches below the caster attachment point of said longitudinal frame members when said creeper is in the open position, wherein said articulating joints permit said creeper to be folded such that said bottom sides of said support panels face each other when said creeper is in the folded position.

21. A foldable creeper as in claim 20, wherein said transverse frame members are spaced from each other when the creeper is in a folded position.

* * * * *